US008372795B2

(12) United States Patent
Corona, III et al.

(10) Patent No.: US 8,372,795 B2
(45) Date of Patent: Feb. 12, 2013

(54) FABRIC CARE COMPOSITIONS COMPRISING A POLY(DIALLYLDIMETHYLAMMONIUM CHLORIDE-CO-ACRYLIC ACID), PROCESS OF MAKING, AND METHOD OF USE

(75) Inventors: Alessandro Corona, III, Mason, OH (US); Gayle Marie Frankenbach, Cincinnati, OH (US); Seth Edward Lindberg, West Chester, OH (US); Mark Robert Sivik, Mason, OH (US); Patrick Thomas Spicer, Cincinnati, OH (US); Gregory Thomas Waning, Fairfield, OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 183 days.

(21) Appl. No.: 12/549,413

(22) Filed: Aug. 28, 2009

(65) Prior Publication Data

US 2010/0056421 A1 Mar. 4, 2010

Related U.S. Application Data

(60) Provisional application No. 61/092,633, filed on Aug. 28, 2008, provisional application No. 61/221,632, filed on Jun. 30, 2009.

(51) Int. Cl.
*C11D 3/37* (2006.01)
*C11D 1/29* (2006.01)

(52) U.S. Cl. ..... 510/438; 510/276; 510/290; 510/300; 510/305; 510/426; 510/443; 510/444

(58) Field of Classification Search ..... 510/276, 510/290, 300, 305, 426, 438, 443, 444
See application file for complete search history.

(56) References Cited

U.S. PATENT DOCUMENTS

| | | | | |
|---|---|---|---|---|
| 3,549,546 | A | 12/1970 | Moore | |
| 3,943,255 | A | 3/1976 | Newkirk | |
| 4,622,161 | A | 11/1986 | Cornelissens et al. | |
| 4,634,544 | A | 1/1987 | Weber et al. | |
| 4,772,462 | A * | 9/1988 | Boothe et al. | 510/123 |
| 4,806,522 | A | 2/1989 | Sprecker | |
| 5,476,660 | A | 12/1995 | Somasundaran et al. | |
| 5,529,696 | A | 6/1996 | Tibbitts | |
| 5,573,709 | A | 11/1996 | Wells | |
| 5,814,596 | A | 9/1998 | Aouad et al. | |
| 5,885,948 | A * | 3/1999 | Glenn et al. | 510/130 |
| 5,904,735 | A | 5/1999 | Gutierrez et al. | |
| 5,955,415 | A | 9/1999 | Gutierrez et al. | |
| 6,156,720 | A | 12/2000 | Boeckh et al. | |
| 6,255,271 | B1 | 7/2001 | Carswell et al. | |
| 6,277,810 | B2 | 8/2001 | Baines et al. | |
| 6,300,304 | B1 | 10/2001 | Boeckh et al. | |
| 6,533,873 | B1 * | 3/2003 | Margosiak et al. | 134/42 |
| 6,569,823 | B2 | 5/2003 | Mooney | |
| 6,573,229 | B2 | 6/2003 | Creeth et al. | |
| 6,576,228 | B1 | 6/2003 | Crookham et al. | |
| 6,620,209 | B2 | 9/2003 | Kischkel et al. | |
| 6,740,633 | B2 | 5/2004 | Nörenberg et al. | |
| 6,846,797 | B1 | 1/2005 | Parker | |
| 6,894,017 | B2 | 5/2005 | Brouwn et al. | |
| 6,903,064 | B1 | 6/2005 | Kasturi et al. | |
| 6,908,490 | B2 | 6/2005 | Boeckh et al. | |
| 6,949,498 | B2 | 9/2005 | Murphy et al. | |
| 7,012,054 | B2 | 3/2006 | Binder et al. | |
| 7,074,750 | B2 | 7/2006 | Hamers et al. | |
| 7,091,167 | B2 | 8/2006 | Lang et al. | |
| 7,141,077 | B2 | 11/2006 | Detering et al. | |
| 7,304,026 | B2 | 12/2007 | Heibel et al. | |
| 2001/0034316 | A1 | 10/2001 | Carswell et al. | |
| 2001/0051142 | A1 | 12/2001 | Duden et al. | |
| 2002/0010121 | A1 | 1/2002 | Van Deurzen et al. | |
| 2002/0010124 | A1 | 1/2002 | Creeth et al. | |
| 2002/0055451 | A1 | 5/2002 | Kischkel et al. | |
| 2002/0058604 | A1 | 5/2002 | Kischkel et al. | |
| 2003/0053980 | A1 * | 3/2003 | Dodd et al. | 424/73 |
| 2003/0104964 | A1 | 6/2003 | Cooper et al. | |
| 2003/0109400 | A1 | 6/2003 | Murphy et al. | |
| 2003/0192130 | A1 | 10/2003 | Kaaret et al. | |
| 2004/0023836 | A1 | 2/2004 | Moorfield et al. | |
| 2004/0033924 | A1 | 2/2004 | Murphy et al. | |
| 2004/0063597 | A1 | 4/2004 | Adair et al. | |
| 2004/0071742 | A1 | 4/2004 | Popplewell et al. | |
| 2004/0071746 | A1 | 4/2004 | Popplewell et al. | |
| 2004/0092425 | A1 | 5/2004 | Boutique et al. | |
| 2004/0139559 | A1 | 7/2004 | Detering et al. | |
| 2004/0152616 | A1 | 8/2004 | Murphy et al. | |
| 2004/0186030 | A1 * | 9/2004 | Hofrichter et al. | 510/130 |
| 2004/0220063 | A1 * | 11/2004 | Chappell et al. | 510/130 |
| 2005/0028293 | A1 | 2/2005 | Geffroy | |
| 2005/0097678 | A1 | 5/2005 | Geffroy | |
| 2005/0101505 | A1 | 5/2005 | Wood | |
| 2005/0153852 | A1 * | 7/2005 | Evans et al. | 510/130 |
| 2005/0153865 | A1 | 7/2005 | Detering et al. | |
| 2005/0158489 | A1 | 7/2005 | Nagata et al. | |
| 2005/0159330 | A1 | 7/2005 | Shah et al. | |
| 2005/0166333 | A1 | 8/2005 | Kaaret et al. | |

(Continued)

FOREIGN PATENT DOCUMENTS

| | | |
|---|---|---|
| CA | 2 177 125 | 12/1996 |
| CA | 2 307 429 A1 | 11/2000 |

(Continued)

OTHER PUBLICATIONS

U.S. Appl. No. 12/549,418, filed Aug. 28, 2009, Corona, III et al.

(Continued)

*Primary Examiner* — Charles Boyer
(74) *Attorney, Agent, or Firm* — Melissa G. Krasovec; Steven W. Miller

(57) ABSTRACT

The instant disclosure relates to processes for making stable compositions via combining a mixture containing at least one cationic polymer and a mixture containing at least one anionic surfactant in the presence of a high energy dispersion step, followed by incorporation of an external structurant using a low energy dispersion step, and compositions made according to the disclosed processes.

19 Claims, No Drawings

U.S. PATENT DOCUMENTS

| | | | | |
|---|---|---|---|---|
| 2006/0003913 | A1 | 1/2006 | Boutique et al. | |
| 2006/0021150 | A1 | 2/2006 | Hu et al. | |
| 2006/0029625 | A1* | 2/2006 | Niebauer | 424/401 |
| 2006/0030513 | A1 | 2/2006 | Binder et al. | |
| 2006/0074005 | A1 | 4/2006 | Kischkel et al. | |
| 2006/0079422 | A1* | 4/2006 | Midha et al. | 510/130 |
| 2006/0083761 | A1* | 4/2006 | Yoshimi et al. | 424/401 |
| 2006/0154836 | A1 | 7/2006 | Sengupta et al. | |
| 2006/0183662 | A1 | 8/2006 | Crotty et al. | |
| 2006/0199756 | A1* | 9/2006 | Creamer et al. | 510/475 |
| 2006/0217288 | A1 | 9/2006 | Wahl et al. | |
| 2006/0276370 | A1 | 12/2006 | Zhang et al. | |
| 2006/0287216 | A1 | 12/2006 | Song | |
| 2007/0027050 | A1 | 2/2007 | Crotty et al. | |
| 2007/0060489 | A1 | 3/2007 | Sun et al. | |
| 2007/0077221 | A1* | 4/2007 | Seigneurin et al. | 424/70.16 |
| 2007/0190009 | A1 | 8/2007 | Guentert et al. | |
| 2007/0277327 | A1 | 12/2007 | Wessling et al. | |
| 2007/0292380 | A1 | 12/2007 | Staudigel et al. | |
| 2008/0096788 | A1 | 4/2008 | Lang | |
| 2008/0103080 | A1 | 5/2008 | Lang | |
| 2008/0103081 | A1 | 5/2008 | Lang | |
| 2008/0131390 | A1 | 6/2008 | Lang | |
| 2008/0160093 | A1* | 7/2008 | Schwartz et al. | 424/489 |
| 2008/0234165 | A1* | 9/2008 | Panandiker et al. | 510/299 |
| 2008/0261845 | A1* | 10/2008 | Yamamoto et al. | 510/159 |
| 2009/0036339 | A1 | 2/2009 | Sans et al. | |
| 2009/0048137 | A1 | 2/2009 | Lang | |
| 2009/0297463 | A1* | 12/2009 | Bureiko et al. | 424/62 |
| 2010/0105592 | A1 | 4/2010 | Yoda et al. | |
| 2010/0307523 | A1* | 12/2010 | Wei et al. | 132/200 |
| 2010/0310644 | A1* | 12/2010 | Liebmann et al. | 424/450 |

FOREIGN PATENT DOCUMENTS

| | | | |
|---|---|---|---|
| DE | 35 31 756 | A | 3/1986 |
| DE | 101 16 491 | A1 | 4/2001 |
| DE | 100 64 635 | A1 | 7/2002 |
| DE | 10 2004 051 715 | A1 | 10/2004 |
| DE | 10 2005 039 168 | | 8/2005 |
| EP | 0 264 710 | A1 | 4/1988 |
| EP | 1 114 139 | B1 | 2/2005 |
| EP | 1 146 110 | B1 | 11/2005 |
| GB | 2 164 657 | A | 3/1986 |
| JP | 04050374 | | 2/1992 |
| JP | 11 148093 | | 6/1999 |
| JP | 2000-272234 | A | 10/2000 |
| JP | P2001-107083 | A | 4/2001 |
| JP | P2002-60788 | A | 2/2002 |
| JP | P2002-60789 | A | 2/2002 |
| JP | P2002-60791 | A | 2/2002 |
| JP | P2002-60800 | A | 2/2002 |
| JP | P2006-22203 | A | 1/2006 |
| JP | P2007-31900 | A | 2/2007 |
| WO | WO 00/17297 | | 3/2000 |
| WO | WO 2006/042716 | A1 | 4/2006 |
| WO | WO 2006/042717 | A1 | 4/2006 |
| WO | WO 2006/086811 | | 8/2006 |
| WO | WO 2006/134044 | A1 | 12/2006 |
| WO | WO 2007/107215 | A1 | 9/2007 |

OTHER PUBLICATIONS

U.S. Appl. No. 12/549,422, filed Aug. 28, 2009, Corona, III et al.
U.S. Appl. No. 12/549,712, filed Aug. 28, 2009, Corona, III et al.
International Search Report for PCT/US2009/054822 mailed Dec. 3, 2009, 6 pages.
International Search Report for PCT/US2009/054716 mailed Nov. 18, 2009, 4 pages.
International Search Report for PCT/US2009/061424 mailed Feb. 5, 2010, 4 pages.
International Search Report for PCT/US2009/061425 mailed Apr. 7, 2010, 4 pages.

* cited by examiner

FABRIC CARE COMPOSITIONS COMPRISING A POLY(DIALLYLDIMETHYLAMMONIUM CHLORIDE-CO-ACRYLIC ACID), PROCESS OF MAKING, AND METHOD OF USE

CROSS REFERENCE TO RELATED APPLICATIONS

This application claims priority under 35 U.S.C. §119(e) to U.S. Provisional Application Ser. No. 61/092,633 filed Aug. 28, 2008, and U.S. Provisional Application Ser. No. 61/221,632 filed Jun. 30, 2009.

FIELD OF THE INVENTION

Compositions comprising a cationic polymer and anionic surfactant are disclosed. In one aspect, a process of making stable compositions comprising cationic polymer and anionic surfactant are disclosed.

BACKGROUND OF THE INVENTION

While combinations of cationic polymers and anionic surfactants may provide certain benefits to a fabric or other substrate, due to the opposing charges, such agents may be difficult to formulate, particularly when higher levels of such materials are used. At higher levels, cationic polymers tend to agglomerate with anionic surfactants, such as those typically used in detergent compositions, to create an unpourable, phase-separated mixture, which is generally not compatible with consumer use.

Accordingly, there is a need for processes that can provide a product containing cationic polymer and anionic surfactant, but which is sufficiently stable and has a rheology profile acceptable to consumers.

SUMMARY OF THE INVENTION

The instant disclosure relates to care and/or cleaning compositions capable of providing one or more benefits to a fabric, particularly a color care benefit, and methods for providing same.

DETAILED DESCRIPTION OF THE INVENTION

As used herein, the articles "a" and "an" when used in a claim, are understood to mean one or more of what is claimed or described.

As used herein, the term "comprising" means various components conjointly employed in the preparation of the compositions of the present disclosure. Accordingly, the terms "consisting essentially of" and "consisting of" are embodied in the term "comprising".

As used herein, the term "additive" means a composition or material that may be used separately from (but including before, after, or simultaneously with) the detergent during a laundering process to impart a benefit to the treated fabric.

As used herein, "charge density" refers to the charge density of the polymer itself and may be different from the monomer feedstock. Charge density may be calculated by dividing the number of net charges per repeating unit by the molecular weight of the repeating unit. The positive charges may be located on the backbone of the polymers and/or the side chains of polymers. For polymers with amine monomers, the charge density depends on the pH of the carrier. For these polymers, charge density is measured at a pH of 7.

As used herein, the term "coacervate" means a particle formed from the association of a cationic polymer and an anionic surfactant in an aqueous environment. The term "coacervate" may be used interchangeably with the terms "primary particle," "colloidal particle," and "aggregate particle."

As used herein, the term "colloidal particles" means an aggregate of primary particles.

As defined herein, "essentially free of" a component means that no amount of that component is deliberately incorporated into the composition.

As used herein, the term "external structurant" refers to a selected compound or mixture of compounds which provides structure to a detergent composition independently from, or extrinsic from, any structuring effect of the detersive surfactants present in the composition.

As used herein, "compositions" include fabric care compositions for handwash, machine wash and/or other purposes and include fabric care additive compositions and compositions suitable for use in the soaking and/or pretreatment of fabrics. They may take the form of, for example, laundry detergents, fabric conditioners and/or other wash, rinse, dryer added products, and sprays. Compositions in the liquid form may be in an aqueous carrier. In other aspects, the fabric care compositions are in the form of a granular detergent or dryer added fabric softener sheet. The term includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; cleaning auxiliaries such as bleach additives and "stain-stick" or pre-treat types, substrate-laden products, dry and wetted wipes and pads, nonwoven substrates, and sponges; and sprays and mists. Various dosage formats may be used. The composition may be provided in pouches, including foil or plastic pouches or water soluble pouches, such as a polyvinyl alcohol (PVA) pouch; dosing balls or containers; containers with readily opened closures, such as pull tabs, screw caps, foil or plastic covers, and the like; or other container known in the art. The compositions may be compact compositions, comprising less than about 15%, or less than about 10%, or less than about 7% water.

As used herein, "High charge density" means a charge density of greater than about 1 meq/g. "Low charge density" means a charge density of less than about 1 meq/g.

As used herein, the phrase "high molecular weight" means a molecular weight of greater than about 1,000,000 kD. The phrase "low molecular weight" means a molecular weight of from about 1,000 to about 500,000 kD.

As used herein, "isotropic" means a clear mixture, (having no visible haziness and/or dispersed particles) and having a uniform transparent appearance.

As used herein, "structured phase" means that portion of a composition comprising primary and/or colloidal particles when separated by centrifugation.

As used herein, the term "continuous phase" means that portion of a composition substantially free from particles upon separation by centrifugation.

As defined herein, "stable" means that no visible phase separation is observed for a period of at least about two weeks, or at least about four weeks, or greater than about a month or greater than about four months, as measured using the Floc Formation Test, described in USPA 2008/0263780 A1.

As defined herein, "unit dose" means an amount of fabric care composition suitable to treat one load of laundry, such as from about 0.05 to about 100 g, or from 10 to about 60 g, or from about 20 to about 40 g.

All measurements are performed at 25° C. unless otherwise specified.

The test methods disclosed in the present application should be used to determine the respective values of the parameters of Applicants' invention.

Unless otherwise noted, all component or composition levels are in reference to the active portion of that component or composition, and are exclusive of impurities, for example, residual solvents or by-products, which may be present in commercially available sources of such components or compositions.

Without being limited by theory, Applicants believe the cationic polymers of the disclosed compositions are useful for providing one or more fabric benefits, such as a color rejuvenation benefit, as a result of cationic polymer coalescence with anionic surfactant to form a coacervate system. This, in turn, is believed to deliver a benefit to the treated fabric without the necessity of dyes or other coloring agents via formation of a thin film on the fiber of the treated fabric. However, the direct combination, for example via simple mixing, of anionic surfactant and cationic polymers yields an unstable solution, wherein the surfactant and polymers aggregate to form an unstable composition with a rheology unsuitable for consumer use. Applicants have recognized that, by separating a mixture of cationic polymer and a mixture of anionic surfactant, and combining via a high energy milling step, surfactant-polymer particles of a certain size can be formed. Without being bound by theory, by forming particles of the dimensions disclosed herein, a stable, homogeneous solution containing cationic polymer and anionic surfactant can be achieved.

In one aspect, a process for preparing a composition comprising a structured phase and optionally, a continuous phase, is disclosed, wherein said process comprises the steps of a. combining a polymer mixture comprising a cationic polymer, and a surfactant mixture comprising an anionic surfactant, using high energy dispersion to form a premix comprising particles comprising cationic polymer and anionic surfactant;
b. introducing a structurant into the premix using low energy dispersion to form a stable composition;
   wherein said stable composition has a resting viscosity of from about 10,000 to about 50,000 cps or from about 20,000 to about 30,000 cps as measured at 0.05/s.

The dispersion energies of steps (a) and (b) can be characterized as having a certain Energy Density, wherein Energy Density is generated by exerting a power density on the feed within the mixing chamber for a residence time. Energy Density can be represented by the equation: $E=W*\Delta T$, wherein E represents energy density, W represents power density, and $\Delta T$ represents residence time. Residence time means the average amount of time a fluid remains within the mixing chamber and is determined by calculating the active volume of the device where the fluid stream receives the highest concentration of power input divided by the flow rate of the stream out of the mixing chamber. The high energy dispersion step can be also be characterized by power density and residence time.

High Energy Dispersion Step—The energy level of the high energy dispersion step may be empirically determined by one of skill in the art, by analysis of the particle size and distribution of the second mixture and subsequent adjustment of the mixing energy applied when generating the mixture, provided the energy level is sufficient to achieve the primary particle size and distribution as described.

The disclosed processes use relatively high power density to achieve the desired colloid attributes. For mechanical high shear mixers, mixing power densities are in the range of 1 W/ml to 1000 W/ml. For high pressure drop mixing equipment (such as sonolators or valve homogenizers) power density ranges from about 1000 W/ml to about 100,000 W/ml (See "A Physical Interpretation of Drop Sizes in Homogenizers and Agitated Tanks, Including the Dispersion of Viscous Oils," J. T. Davies, Chemical Engineering Science, Vol. 42, No 7, pp 1671-1676, 1987.

The energy level may be applied in an amount sufficient to achieve the primary particle size and distribution disclosed herein. In one aspect, the high energy dispersion step may have an Energy Density of from about 0.1 to about 100 J/ml, or from about 0.5 to about 50 J/ml, or from about 1 to about 10 J/ml.

In one aspect, the energy density may be generated from a power density of from about 0.01 to about 1,000,000 W/ml, or from about 0.1 to about 100,000 W/ml. The residence time may be from about 1 millisecond to about 10 seconds, or from about 1 millisecond to about 1 second, or from about 2 milliseconds to about 100 milliseconds.

In one aspect, the residence time may be less than 10 seconds and the power density may be greater than about 0.01 W/ml. In one aspect, the residence time may be less than 1 second and the power density may be greater than about 0.1 W/ml. In one aspect, the residence time may be less than 100 milliseconds and the power density may be greater than about 1 W/ml.

In one aspect, metered streams of the polymer mixture and surfactant mixture may be combined continuously in a pipe where the fluids are intimately contacted with each other in one or more high shear mechanical or static mixers. Mechanical mixers include rotor stator mills (e.g. manufactured by IKA, Silverson, Quadro-Ytron), colloid mills (IKA, Premier), Stirred Bead Mills (Romaco)). Static mixers may consist of an array of similar, stationary mixing elements, placed one behind the other in a pipe or channel (eg. manufactured for instance by Sulzer Ltd., Koch-Glitsch Inc., and Chemineer Inc). Static mixers suitable for this process also include orifice, microchannel or valve-type mixers. For instance, venturi mixers, microfluidizers (Microfluidics), Sonolator (Sonic Corp.), pressure homogenizers (BEEI, GEA Niro-Soavi, Arde Barinco, Niro). The polymer mixture may be contacted with the surfactant mixture in an agitated batch making tank to form the premix. To insure sufficient mixing, the polymer mixture may be injected into the high shear region of a high shear blender (e.g. IKA T-series batch high shear mixers). The mixing device energy may be any device, provided that sufficient energy is provided to create colloid particles of the desired composition, unit particle size, and particle birefringent optical characteristics. Fine mixing of the polymer mixture with the surfactant mixture results in the formation of primary particles having a primary particle size distribution as described above dispersed in the third mixture, or "premix." Any larger than desired particles formed during blending can also be reduced in size by additional high shear milling steps. The premix can then be used for subsequent formulation as either a detergent, additive, rinse-added solution, or the like.

Low Energy Dispersion Step—The structurant may be incorporated into the third solution/premix with a low energy dispersion step sufficient to achieve adequate incorporation of structuring agents to aid in suspension of the colloid particles in the composition. Incorporation mixing processes can be in the form of continuous static mixers or batch tank agitation where power densities range from about 0.0001 W/ml to about 10 W/ml. In some cases, mechanical high shear mixers and constricted flow type (e.g. orifices) mixers with power densities of from about 1 W/ml to about 1000 W/ml can be used.

In one aspect, the low energy dispersion of step (b) has an energy density from about 0.001 to about 1 J/ml, or from about 0.1 to about 10 J/ml, or from about 0.005 to about 0.5 J/ml. In another aspect, the energy density is generated from a power density of from about 0.0001 W/ml to about 10 W/ml, alternatively from about 1 W/ml to about 1000 W/ml.

In one aspect, the low energy dispersion of step (b) may comprise an energy density generated from a power density of from about 0.01 to about 1,000,000 W/ml, or from about 0.1 to about 100,000 W/ml wherein the residence time may be from about 1 millisecond to about 10 seconds, or from about 1 millisecond to about 1 sec, or from about 2 milliseconds to about 100 ms. In one aspect, when the residence time is less than 10 seconds, the power density may be greater than about 0.01 W/ml. In one aspect, when the residence time is less than 1 second, the power density may be greater than about 0.1 W/ml. In one aspect, when the residence time is less than 100 milliseconds, the power density may be greater than about 1 W/ml.

For structurants that are shear-sensitive (i.e. those that lose structuring capability when subjected to high energy density processing) the energy input from the mixing device may be lowered so as to prevent damage to the structurant. Entrainment of air may be limited throughout the process.

Particles—In one aspect, the particles may comprise primary particles having a primary particle size of from about 0.05 to about 500 μm, or from about 0.1 to about 250 μm, or from about 0.5 to about 50 μm. In one aspect, from about 70% to about 100%, based on total number of primary particles, of the primary particles have a particle size within this range. In one aspect, the high energy dispersion step may form primary particles having a primary particle size distribution such that at least 70% of the primary particles, based on total number of primary particles, have a particle size of less than about 50 μm.

In one aspect, the particles may comprise colloidal particles, wherein the colloidal particles have a colloidal particle size from about 0.05 to about 1000 μm, or from about 0.5 to about 500 μm, or from about 1.0 to about 50 μm. In one aspect, from about 70% to about 100% of the colloidal particles, based on total number of colloidal particles, have a particle size within this range. In one aspect, the high energy dispersion step may form colloidal particles having a colloidal particle size distribution such that at least 70% of the colloidal particles, based on total number of colloidal particles, have a particle size of less than about 500 μm.

Polymer Mixture—In one aspect, the cationic polymer may comprise a cationic polymer produced by polymerization of ethylenically unsaturated monomers using a suitable initiator or catalyst. These are disclosed in WO 00/56849 and U.S. Pat. No. 6,642,200.

In one aspect, the cationic polymer may be selected from the group consisting of cationic or amphoteric polysaccharides, polyethyleneimine and its derivatives, a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N,N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropylpentamethyl-1,3-propylene-2-ol-ammonium dichloride, N,N,N,N',N',N'',N''-heptamethyl-N''-3-(1-oxo-2-methyl-2-propenyl)aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof. The cationic polymer may optionally comprise a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may be a terpolymer made from more than two monomers. The polymer may optionally be branched or cross-linked by using branching and crosslinking monomers. Branching and crosslinking monomers include ethylene glycoldiacrylate divinylbenzene, and butadiene. In one aspect, the cationic polymer may include those produced by polymerization of ethylenically unsaturated monomers using a suitable initiator or catalyst, such as those disclosed in WO 00/56849 and U.S. Pat. No. 6,642,200. In one aspect, the cationic polymer may comprise charge neutralizing anions such that the overall polymer is neutral under ambient conditions. Suitable counter ions include (in addition to anionic species generated during use) include chloride, bromide, sulfate, methylsulfate, sulfonate, methylsulfonate, carbonate, bicarbonate, formate, acetate, citrate, nitrate, and mixtures thereof.

In one aspect, the cationic polymer may be selected from the group consisting of poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-methacryloamidopropyl-pentamethyl-1,3-propylene-2-ol-ammonium dichloride). These cationic polymers include and may be further described by the nomenclature Polyquaternium-1, Polyquaternium-5, Polyquaternium-6, Polyquaternium-7, Polyquaternium-8, Polyquaternium-1, Polyquaternium-14, Polyquaternium-22, Polyquaternium-28, Polyquaternium-30, Polyquaternium-32 and Polyquaternium-33, as named under the International Nomenclature for Cosmetic Ingredients.

In one aspect, the cationic polymer may comprise a cationic acrylic based polymer. In one aspect, the cationic polymer may comprise a cationic polyacrylamide. In one aspect, the cationic polymer may comprise poly(acrylamide-N,N-dimethylaminoethyl acrylate) and its quaternized derivatives. In this aspect, the cationic polymer may be that sold under the tradename Sedipur®, available from BTC Specialty Chemicals, BASF Group, Florham Park, N.J.

In one aspect, the cationic polymer may comprise poly (acrylamide-co-methacrylamidopropyltrimethyl ammonium chloride).

In one aspect, the cationic polymer may comprise a non-acrylamide based polymer, such as that sold under the tradename Rheovis® CDE, available from Ciba Specialty Chemicals, a BASF group, Florham Park, N.J., or as disclosed in USPA 2006/0252668.

In one aspect, the cationic polymer may comprise polyethyleneimine or a polyethyleneimine derivative. In one aspect, the cationic polymer may be a polyethyleneinine such as that sold under the tradename Lupasol® by BASF, AG, Lugwigschaefen, Germany In one aspect, the cationic polymer may include alkylamine-epichlorohydrin polymers, which are reaction products of amines and oligoamines with epicholorohydrin. These include those polymers listed in U.S. Pat. Nos. 6,642,200 and 6,551,986. Examples include dimethylamine-epichlorohydrin-ethylenediamine, and available under the trade name Cartafix® CB and Cartafix® TSF from Clariant, Basle, Switzerland.

In one aspect, the cationic polymer may comprise a synthetic cationic polymer comprising polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™. These polymers are described in Wet Strength resins and their applications edited by L. L. Chan, TAPPI Press (1994), at pp. 13-44.

In one aspect, the cationic polymer may be selected from the group consisting of cationic or amphoteric polysaccharides. In one aspect, the cationic polymer may comprise a polymer selected from the group consisting of cationic and amphoteric cellulose ethers, cationic or amphoteric galactomanan, cationic guar gum, cationic or amphoteric starch, and combinations thereof.

In one aspect, the cationic polymer may comprise an amphoteric polymer, provided the polymer possesses a net positive charge. Said polymer may have a cationic charge density of about 0.05 to about 18 milliequivalents/g.

In one aspect, the cationic polymer may have a cationic charge density of from about 0.005 to about 23 milliequivalents/g, from about 0.01 to about 12 milliequivalents/g, or from about 0.1 to about 7 milliequivalents/g, at the pH of the intended use of the composition. For amine-containing polymers, wherein the charge density depends on the pH of the composition, charge density is measured at the intended use pH of the product. Such pH will generally range from about 2 to about 11, more generally from about 2.5 to about 9.5. Charge density is calculated by dividing the number of net charges per repeating unit by the molecular weight of the repeating unit. The positive charges may be located on the backbone of the polymers and/or the side chains of polymers.

In one aspect, the cationic polymer may have a weight-average molecular weight of from about 500 to about 5,000,000 Daltons, or from about 1,000 to about 2,000,000 Daltons, or from about 2,500 to about 1,500,000 Daltons as determined by size exclusion chromatography relative to polyethyleneoxide standards with RI detection. In one aspect, the molecular weight of the cationic polymer may be from about 500 to about 37,500 kD. The cationic polymers may also range in both molecular weight and charge density. The cationic polymer may have a charge density of from about 0.05 to about 12 meq/g, or from about 1.0 to about 6 meq/q, or from about 3 to about 4 meq/g at a pH of from about 3 to about 9. In one aspect, the one or more cationic polymer may have a weight-average molecular weight of 500 to about 37,500 Daltons and a charge density of from about 0.1 meq/g to about 12.

In one aspect, the polymer mixture may have a viscosity of from about 1 to about 1,000, or from about 400 to about 800 cps at 20/s.

In one aspect, the polymer mixture may optionally include a surfactant selected from the group consisting of anionic surfactants, nonionic surfactants, cationic surfactants, zwitterionic surfactants, and combinations thereof.

In one aspect, the polymer mixture may be isotropic.

In one aspect, the polymer mixture may comprise a structurant.

Surfactant Mixture—In one aspect, the surfactant mixture may comprise anionic surfactant. Non-limiting examples of suitable anionic surfactants include those described in USPA 12/075333. In one aspect, the HLB value of the anionic surfactant may be from about 4 to about 14, or from about 8 to about 10, or about 9. In one aspect, the surfactant The surfactant mixture may be provided in the form of a solution comprising, based on total weight of the surfactant mixture, from about 10% to about 70% of a solvent. The solvent may comprise a low molecular weight water-miscible molecule. In one aspect, the solvent may be water.

In one aspect, the surfactant mixture may have a viscosity of from about 1 to about 1,000 cps at 20/s, or from about 400 to about 800 cps at 20/s, or about 400 cps at 20/s.

In one aspect, the surfactant mixture may have a pH of about 7.0. The pH may be adjusted, using any suitable pH adjusting agent.

In one aspect, the surfactant mixture may be isotropic.

In one aspect, the surfactant mixture may comprise a structurant.

The polymer and surfactant mixtures may be prepared by means familiar to those in the art. The polymer mixture and/or surfactant mixture can optionally include one or more adjunct ingredients as described herein.

Composition—In one aspect, the composition may comprise, based on total weight of the composition, from about 0.1% to about 30%, or from about 0.5% to about 20%, or from about 1.0% to about 10%, or from about 1.5% to about 8%, of a cationic polymer. In one aspect, the composition may comprise, based on total weight of the composition, of from about 2% to about 50%, or from about 5% to about 25%, or from about 12% to about 20% of an anionic surfactant. The anionic surfactant may comprise a surfactant selected from the group consisting of nonionic surfactants, cationic surfactants, zwitterionic surfactants, and combinations thereof. In one aspect, the composition may comprise, based on total weight of the composition, from about 1.0% to about 50%, or from about 7% to about 40%, or from about 10% to about 20% of alkylethoxysulfonate (AES). In one aspect, the composition may comprise, based on total weight of the composition, less than about 5%, or less than about 10%, or less than about 50% HLAS.

In one aspect, the composition may comprise, based on total weight of the composition, from about 0.001% to 1.0%, or from 0.05% to 0.5%, or from 0.1% to 0.3% of an external structurant. Suitable structurants include those described, for example, in USPAs 2007/169741B2 and 2005/0203213. In one aspect, the structurant may comprise hydrogenated castor oil, commercially available as under the trade name Thixin®.

In one aspect, the composition may have a resting (low shear) viscosity of greater than about 10,000 cps@0.05/s. In another aspect, the low shear viscosity may be from about 10,000 to about 225,000 cps@0.05/s, or from about 30,000 to about 100,000 cps@0.05/s, or from about 10,000 to about 50,000 cps@0.05/s.

In one aspect, the composition may comprise a dispersing agent. The composition may comprise, based on total weight of the composition, from about 0% to about 7%, or from about 0.1% to about 5%, or from about 0.2% to about 3% of a dispersing agent. In one aspect, the dispersing agent may be substantially water soluble. The dispersing agent may be present in the surfactant mixture, the polymer mixture, the premix, the final composition, or a combination thereof.

In one aspect, the dispersing agent may be a nonionic surfactant. Suitable nonionic surfactants include addition products of ethylene oxide and, optionally, propylene oxide, with fatty alcohols, fatty acids, fatty amines, etc. They may be referred to herein as ethoxylated fatty alcohols, ethoxylated fatty acids, and ethoxylated fatty amines. Any of the ethoxylated materials of the particular type described hereinafter can be used as the nonionic surfactant. Suitable compounds include surfactants of the general formula: $R^1$—Y—$(C_2H_4O)_Z$—$C_2H_4OH$ wherein $R^1$ may be selected from the group consisting of primary, secondary and branched chain alkyl and/or acyl and/or acyl hydrocarbyl groups; primary, secondary and branched chain alkenyl hydrocarbyl groups, and primary, secondary and branched chain alkyl- and alkenyl substituted phenolic hydrocarbyl groups; said hydrocarbyl groups having a hydrocarbyl chain length of from about 8 to about 20, or from about 9 to about 18 carbon atoms. In the general formula for the ethoxylated nonionic surfactants herein Y may be —O—, —C(O)O—, or —O—, and in which $R^1$, when present, have the meanings given hereinbefore, and z may be at least about 4, or about 7 to about 25.

In one aspect, the dispersing agent may include a material having the general formula: $R^1O(CH(R^2)CH_2O)x(CH_2CH_2O)yR^3$ or $R^1O(CH_2CH_2O)x(CH(R^2)CH_2O)yR^3$ wherein $R^1$ may be defined as above; $R^2$ may be a $C_1$-$C_3$ alkyl unit; $R^3$ may be hydrogen or $C_1$-$C_3$ alkyl, wherein x is from 1 to 100, and wherein y is from 0 to 20. The individual alkoxy monomers may be arranged blockwise or randomly. Non-limiting examples include the Plurafac® surfactants from BASF. Other suitable dispersing agents include the so-called propyleneoxide/ethyleneoxide block copolymers, having the following general structure: $HO(CH_2CH2O)x(CH(CH_3)CH_2O)y(CH_2CH_2O)zH$, wherein x is from 1 to 100, wherein y is from 0 to 20, and z is from 0 to 100. Such agents include the Pluronic® PE compounds available from BASF.

Adjunct ingredients—Adjunct ingredient may comprise a material selected from the group consisting of fatty acids, brighteners, chelating agents, dye transfer inhibiting agents, enzymes, enzyme stabilizers, and pearlescent agents. Such adjuncts may be suitable for use in the instant compositions and may be desirably incorporated in certain aspects. In addition to the disclosure below, suitable examples of such other adjuncts and levels of use may be found in U.S. Pat. Nos. 5,576,282, 6,306,812 B1 and 6,326,348 B1. The adjunct ingredients may be provided in the surfactant mixture, the polymer mixture, the premix, the final composition, or any combination thereof.

The stability of compositions made according to the disclosed methods as compared to compositions made via simple mixing is set forth in Table 1.

TABLE 1

Composition Stability

| Composition | Process Used | Phase Stability |
|---|---|---|
| 3% Merquat 100, 17% AES (anionic surfactant) using water as a carrier | High energy dispersion | Stable for 4 months |
| 3% Merquat 100, 17% AES (anionic surfactant) using water as a carrier | Simple mixing | Phase split after 2 days |

TABLE 2

Composition properties and rheology

| Composition | Formula I | Formula I | Formula I | Formula I |
|---|---|---|---|---|
| Process | Simple Mixing | High Energy Dispersion Step | High Energy Dispersion Step | High Energy Dispersion Step |
| Primary Particle Size | 10-500 micron | 2 to 10 micron | 2 to 10 micron | 2 to 10 micron |
| Aggregate | Many structures >100 micron | 10 to 100 micron | 10 to 100 micron | 10 to 100 micron |
| Structurant | — | — | 0.1% Trihydroxystearin | 0.3% Trihydroxystearin |
| Visual Appearance | Contains chunks of solid-like material | Smooth, fluid, opaque-translucent | Smooth fluid, opaque-translucent | Higher viscosity, opaque |
| Stability at 70 F. | Separates in 24 hrs | 4 Days | at least 2 weeks | at least 4 months |
| Shear Rate 0.1 $s^{-1}$ | 15,000 cps | 6,500 cps | 10,000 cps | 50,000 cps |
| Shear Rate 10 $s^{-1}$ | 1,200 cps | 1,000 cps | 600 cps | 2,000 cps |

Test Methods

Particle sizing—Particle size and structure in neat product (i.e., undiluted composition as described herein) is determined via light microscopy. A drop of neat product is placed on a glass microscope slide and covered with a glass coverslip. The coacervate particles are identified by their birefringent nature indicating a liquid crystalline character. These coacervate particles can be identified from other possible particulates in the formulation both by this birefringent nature, and either by inspection of the formulation in the absence of cationic polymer, and hence, in the absence of coacervate formation, or by systematic evaluation of other components in the mixture. Quantification of primary and colloidal particle size is completed by image analysis of the microscopy pictures. Often enhanced contrast techniques are used to improve contrast between the coacervate particles and the surrounding liquid, including differential interference contrast, phase contrast, polarized light, and/or the use of fluorescent dyes. Additional droplets are imaged to ensure that the resulting images and particle sizes are representative of the entire mixture.

Particle size under dilution may be determined using microscopy (light microscopy as described above, or electron microscopy if the particles are too small to be visible by light microscopy) and/or laser scattering techniques such as laser diffraction with Mie theory, dynamic light scattering, or focused beam reflectance mode. Often these techniques are used together, in that microscopy is used to identify the coacervate particles from other possible particulates in solution and scattering techniques offer a more rapid quantification of particle size. The choice of scattering method depends on the particle size of interest and the concentration level of particles in solution. In dynamic light scattering (DLS), the fluctuations in scattered light due to Brownian motion of the particles are measured. These fluctuations are correlated to obtain a diffusion coefficient and therefore a hydrodynamic radius of particles. This technique is used when the particles are less than a few microns and the solution conditions are dilute. In laser diffraction, the light scattered by the particles is measured by a series of detectors placed at different angles. The use of back scattering detectors and Mie theory enables detection of particle sizes less than 1 micron. This technique can be utilized to measure particles over a broader size range compared to DLS, and resolution of two populations of particle sizes (such as primary and colloidal particles) can be determined provided the difference in sizes is significant enough. In a focused beam reflectance measurement (FBRM), a chord length distribution, which is a "fingerprint" of the particle size distribution, is obtained. In FBRM, a focused laser beam scans across particles in a circular path, and as the beam scans across particles the backscattered light is detected as pulses of light. The duration of the pulse is converted to a chord length, and by measuring thousands of chord lengths each second, the chord length distribution is generated. As in the case of laser diffraction, detection of two size populations can be obtained provided the differences in size is great enough. This technique is used when the particles are greater than approximately 1 micron and is particularly useful when the turbidity and/or particle concentration in solution is high.

EXAMPLES

Example I

The base composition is made by adding the component materials of Table 3 into a dish bottom tank. The component materials are mixed by hand to minimize the amount of air entrapped in the mixture. Upon complete blending, the resulting base composition is clear and isotropic, having a viscosity of from about 200 to about 800 cPS at 20 s−1. 71 liters of base composition is then combined with 25 liters of the isotropic polymer solution. To form the polymer solution, the neat polymer (Nalco, Merquat 100, Homopolymer of diallyldimethyl ammonium chloride, polymer molecular weight of from about 100,000 to about 150,000, ~40% active) is diluted with water to form an 11.9% active polymer solution. The base composition is delivered at a rate of 3500 g/min using a Waukesha Pump Model (00602) and the polymer solution is delivered at a rate of 1265 g/min using a Pump (Moyno, E4ASSF3-SKA). The polymer solution and base composition are delivered simultaneously to the head of mill (IKA DR2000/5, two fine grindsets, 50% energy setting). The polymer solution is delivered via a dip tube inserted into the tubing such that the polymer solution is delivered as close as possible to the top of the grind sets without touching, thereby eliminating any air gap between the polymer introduction and dispersion with the base composition. Upon mixing of the base composition and the polymer solution as described above, a mixture containing colloidal particles is formed. Successful attainment of the colloidal particles can be confirmed at this step wherein a dispersed phase of colloid particles suspended in the product is visible via microscopy, the colloidal particles having a diameter of from about 10 to 20 um. Successful attainment of the colloidal particles can also be verified via observation of visible regions of birefringence in the dispersed phase using cross Polared microscopy.

After the polymer solution stream and the base composition stream are combined as described above to obtain a mixture containing colloidal particles, 3.75 liters of Thixcin®, an organic derivative of castor oil, available from Elementis) is introduced at a flow rate of 190 g/min using a Waukesha pump similar to the base composition one (Waukesha, 00618?) The Thixcin® is incorporated at the output of the mill to ensure rapid dispersion of the structurant into the colloid product via-a static mixer (12 element SMX static mixer (1" size) (Sulzer Chemtech). The mixing is complete when the product is passed through the 12 element 1" diameter static mixer at a flow rate of 5kg's/min. The product is then transferred to a storage container. The final product has a rheology profile of about 20,000-50,000 at low shear (0.5 s−1) and about 200-600 cPS at higher shear (20 s−1). All processing steps are carried out at ambient temperatures (20° C.).

TABLE 3

Base Composition Formulation

| Component Material | Base Composition (wt %) |
|---|---|
| C25 AE1.8S surfactant[1] | 17.736% |
| Sodium Hydroxide[2] | 2.513% |
| Monoethanol Amine[3] | 2.217% |
| 1,2 Propanediol[4] | 3.236% |
| Diethylene Glycol[5] | 1.419% |
| DTPA (diethylene triamine penta acetate)[6] | 0.443% |
| Citric Acid[7] | 2.956% |
| Sodium Cumene sulfate[8] | 1.552% |
| C12-C18 Fatty Acid[9] | 1.848% |
| Ethoxylated tetraethylene pentaimine[10] | 0.517% |
| Ethanol[11] | 2.483% |
| Perfume | 0.61% |
| N4 Amine (N,N'-Bis(3-aminopropyl)ethylenediamine)[12] | 0.04% |
| Merquat 100[13] | 25.316% |
| Thixcin ® (organic derivative of castor oil)[14] | 0.15% |
| Water | to 100% |

[1]Available from The Procter & Gamble Company.
[2]Available from Sigma Aldrich.
[3]Available from Sigma Aldrich.
[4]Available from Sigma Aldrich.
[5]Available from Sigma Aldrich.
[6]Available from Sigma Aldrich.
[7]Available from Archer Daniels Midland.
[8]Available from Rutgers Organics.
[9]Available from Twin Rivers.
[10]Available from BASF.
[11]Available from Mays Chemical.
[12]Available from BASF.
[13]Polymer available from Nalco; solution made according to Example I.
[14]Available from Elementis.

TABLE 4

Exemplary Detergent Formulations

| Component Material | | Formula 1 | 2 | 3 | 4 | 5 | 6 | 7 | 8 | 9 | 10 |
|---|---|---|---|---|---|---|---|---|---|---|---|
| | | Wt % | | | | | | | | | |
| Alkyl Ethoxylate sulfate | 5.0-20 | 20.1 | 20.5 | 18 | 15 | 20.1 | 20.1 | 15 | 20.1 | 20.1 | 20.1 |
| HLAS (1) | 0-10.0 | — | — | — | — | — | — | — | — | — | — |
| MLAS (2) | 0-5.0 | — | — | — | — | — | — | — | — | — | — |
| Alkyl Ethoxylate | 0-5.0 | 0.3 | 2.0 | 1.5 | 4.0 | 0.5 | 0.7 | 2.5 | 0.3 | 0.3 | 0.3 |
| Lauryl trimethyl ammonium chloride (3) | 0-4.0 | 2.2 | — | — | — | — | — | — | — | — | — |
| Citric Acid | 0-5.0 | 3.4 | 3.4 | 3.4 | 3.4 | 3.4 | 3.4 | 3.4 | 3.4 | 3.4 | 3.4 |
| C1218 TPK FA (4) | 0-5.0 | 2.1 | 0 | 5.0 | 10 | 2.1 | 2.1 | 2.1 | 2.1 | 2.1 | 2.1 |
| Enzyme 54.5 mg/g active (5) | 0-1.0 | 0.4 | 0.4 | 0.4 | 0.4 | 0.4 | 0.4 | 0.4 | 0.4 | 0.4 | 0.4 |
| Natalase - 200L | 0-0.1 | — | 0.3 | — | — | — | — | — | — | — | — |
| Carezyme - 0.5L | 0-0.5 | — | 0.1 | 0.05 | — | — | — | — | 2.0 | — | — |
| Borax | 0-3 | 0.8 | 0.8 | 0.8 | 0.8 | 0.8 | 0.8 | 0.8 | 0.8 | 0.8 | 0.8 |
| Ca Formate | 0-0.1 | — | — | — | — | — | — | — | — | — | — |
| ethoxylated tetraethylene pentaimine | 0-2.0 | 0.7 | — | — | 0.7 | 0.7 | 0.8 | 0.7 | 0.5 | — | 0.7 |
| PE20 (6) | 0-3.0 | 0.7 | 0.7 | 0.7 | 0.7 | 0.7 | 0.7 | 0.7 | 1.5 | 2.0 | 0.7 |
| DTPA (7) | 0-1.0 | 0.5 | 0.5 | 0.5 | 0.5 | 0.5 | 0.5 | 0.5 | 0.5 | 0.5 | 0.5 |
| FWA-15 (8) | 0-0.3 | 0.1 | 0.1 | 0.1 | 0.1 | 0.1 | 0.1 | 0.1 | 0.1 | 0.1 | 0.1 |
| Merquat 100 (9) | 1.0-4.0 | 2.0 | 2.0 | 2.0 | 3.0 | 2.0 | 3.0 | 4.0 | — | 1.5 | — |
| Merquat 106 (10) | 1.0-4.0 | — | — | — | — | — | — | — | 4.0 | — | — |
| Cartafix TSF (12) | 0-3.0 | 2.0 | 2.0 | — | — | 2.0 | — | — | — | 1.0 | — |
| Merquat 5 (13) | | — | — | 2.0 | — | — | — | — | — | — | 3.0 |
| Polyvinyl Pyrrolidone | | — | — | — | 0.5 | — | 0.3 | — | — | — | — |
| PP5495 (14) | 0-4.0 | 2.0 | 2.0 | 2.0 | 2.0 | 0.5 | — | — | — | 0.5 | 1.0 |
| Ethanol | 0-4.0 | 2.8 | 2.8 | 2.8 | 2.8 | 2.8 | 2.8 | 2.8 | 2.8 | 2.8 | 2.8 |
| PEG400 | | 1.5 | 1.5 | 1.5 | 1.5 | 1.5 | 1.5 | 1.5 | 1.5 | 1.5 | 1.5 |
| 1,2-propanediol | 0-6.0 | 3.8 | 3.8 | 3.8 | 3.8 | 3.8 | 3.8 | 3.8 | 3.8 | 3.8 | 3.8 |
| MEA (mono-ethanol amine) | 0-4.0 | 2.5 | 2.5 | 2.5 | 2.5 | 2.5 | 2.5 | 2.5 | 2.5 | 2.5 | 2.5 |
| NaOH | | As Needed to pH 6-9 | | | | | | | | | |
| Na Cumene sulfonate | 0-3.0 | 1.8 | 1.8 | 1.8 | 1.8 | 1.8 | 1.8 | 1.8 | 1.8 | 1.8 | 1.8 |
| Na formate | 0-0.5 | 0.2 | 0.2 | 0.2 | 0.2 | 0.2 | 0.2 | 0.2 | 0.2 | 0.2 | 0.2 |
| Trihydroxyl-stearin | 0-0.5 | 0.2 | 0.2 | 0.2 | 0.2 | 0.2 | 0.2 | 0.2 | 0.2 | 0.2 | 0.2 |
| Suds Suppressor | 0-1.0 | — | — | — | — | — | — | — | — | — | — |
| Acusol OP 301 opacifier | 0-0.5 | — | — | — | — | — | — | — | — | — | — |
| N4 amine | 0-0.02 | 0.2 | 0.2 | — | 0.2 | — | 0.2 | 0.2 | 0.2 | 0.2 | 0.2 |
| Perfume | 0.3-2.5 | 1-2 | 1-2 | 1-2 | 1-2 | 1-2 | 1-2 | 1-2 | 1-2 | 1-2 | 1-2 |
| Water | | Balance to 100% | | | | | | | | | |

(1) Linear alkylbenzene sulfonate.
(2) Mid-chain branched linear alkylbenzene sulfonate.
(3) lauryl trimethyl ammonium chloride.
(4) Topped palm kernel fatty acid.
(5) Protease, genetically engineered variant of the detergent protease from *Bacillus Amyloliquifaciens*.
(6) polyethyleneimine MW600 EO20.
(7) diethylene triamine penta acetate.
(8) disodiuma 4,4'-bis{[4-anilino-6-morpholino-s-triazin-2-yl]-amino}-2,2'-stilbenedisulfonate.
(9) Homopolymer of diallyldimethyl ammonium chloride, polymer molecular weight of from about 100,000 to about 150,000.
(10) Homopolymer of diallyldimethyl ammonium chloride, polymer molecular weight from about 5,000 to about 15,000.
(11) Co-polymer of dimethyldiallyl ammonium chloride and acrylic acid, molecular weight of about 450,000 to 550,000 Daltons.
(12) Terpolymer of dimethylamine-epichlorohydrin-ethylenediamine.
(13) Poly(acrylamide-co-methacryloyloxyethyltrimethyl ammonium methylsulfate)
(14) Dimethyl, methyl (polyethylene oxide acetate capped) siloxane.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for preparing a fabric care composition comprising a structured phase and optionally, a continuous phase, comprising the steps of a. combining a polymer mixture comprising poly(diallyldimethylammonium chloride-co-acrylic acid) and a surfactant mixture comprising an anionic surfactant and an enzyme using high energy dispersion to form a premix comprising particles comprising poly(diallyldimethylammonium chloride-co-acrylic acid) and anionic surfactant;

b. introducing a structurant into said premix using low energy dispersion to form a stable composition;

wherein said stable composition has a resting viscosity of from about 10,000 to about 50,000 cps at 0.05/s.

2. A process according to claim 1 wherein said high energy dispersion of step (a) has an Energy Density of from about 0.1 to about 100 J/ml.

3. A process according to claim 1 wherein said high energy dispersion of step (a) is generated from a power density of from about 0.01 to about 1,000,000 W/ml, wherein the residence time is from about 1 millisecond to about 10 seconds.

4. A process according to claim 1 wherein said low energy dispersion of step (b) has an energy density from about 0.001 to about 1 J/ml.

5. A process according to claim 1 wherein said low energy dispersion of step (b) has an energy density generated from a power density of from about 0.01 to about 1,000,000 W/ml wherein the residence time may be from about 1 millisecond to about 10 seconds.

6. A process according to claim 1 wherein said particles comprise primary particles having a particle size of from about 0.05 to about 500 μm.

7. A process according to claim 1 wherein said particles comprise colloidal particles having a particle size of from about 0.05 to about 1000 μm.

8. A process according to claim 1, wherein said polymer mixture comprises a cationic polymer having a charge density of from about 0.05 to about 7 meq/g at a pH of from about 3 to about 9.

9. A process according to claim 1, wherein said polymer mixture comprises a cationic polymer having a weight average molecular weight of from about 500 to about 10,000,000 Daltons.

10. A process according to claim 1, wherein said polymer mixture comprises a cationic polymer having a weight-average molecular weight less than 37,500 Daltons and a charge density greater than about 5 meq/g.

11. A process according to claim 1 wherein the polymer mixture has a viscosity of from about 1 to about 1,000 cps at 20/sec.

12. A process according to claim 1 wherein the polymer mixture is isotropic.

13. A process according to claim 1 wherein the polymer mixture comprises a surfactant.

14. A process according to claim 1, wherein said surfactant mixture comprises a surfactant having an HLB of from about 4 to about 14.

15. A process according to claim 1, wherein said surfactant mixture comprises alkylethoxylated sulfate.

16. A process according to claim 1 wherein said surfactant mixture is isotropic.

17. A process according to claim 1 wherein one or both of the polymer mixture and/or surfactant mixture comprises a dispersing agent.

18. A process for preparing a fabric care composition comprising a structured phase and optionally, a continuous phase, comprising the steps of a. combining a polymer mixture comprising poly(diallyldimethylammonium chloride-co-acrylic acid) and a surfactant mixture comprising alkyl ethoxylate sulfate using high energy dispersion to form a premix comprising particles comprising poly(diallyldimethylammonium chloride-co-acrylic acid) and alkyl ethoxylate sulfate;

b. introducing a structurant into said premix using low energy dispersion to form a stable composition;

wherein said stable composition has a resting viscosity of from about 10,000 to about 50,000 cps at 0.05/s.

19. A process according to claim 18 wherein said particles comprise colloidal particles having a particle size of from about 1 to about 50 μm.

* * * * *